United States Patent [19]

Yoshida et al.

[11] Patent Number: 5,001,820

[45] Date of Patent: Mar. 26, 1991

[54] ROLL FOR ROLLING MILL

[75] Inventors: Masujiro Yoshida, Yokohama; Masao Nitanda, Tokyo; Heiji Kato, Yokosuka; Isao Imai, Fujisawa; Tsukasa Oyauchi, Yokohama, all of Japan

[73] Assignee: Ishikawajima-Harima Jukogyo Kabushiki Kaisha, Japan

[21] Appl. No.: 544,332

[22] Filed: Jun. 27, 1990

[51] Int. Cl.[5] ..... B21B 31/30

[52] U.S. Cl. ..... 29/113.2; 29/116.2; 29/122

[58] Field of Search ..... 29/113.2, 116.2, 122

[56] References Cited

U.S. PATENT DOCUMENTS 4,599,770 7/1986 Kato .
4,602,408 7/1986 Noé et al. ..... 29/113.2
4,837,906 6/1989 Mori et al. ..... 29/122 X

FOREIGN PATENT DOCUMENTS 1181906 7/1989 Japan ..... 29/113.2
1169766 7/1985 U.S.S.R. ..... 29/116.2

*Primary Examiner*—Timothy V. Eley
*Assistant Examiner*—R. Martin

[57] ABSTRACT

Axially extending liquid-tight tapered spaces are defined in the barrel of a roll body. Tapered pistons are fitted in the spaces for engagement and disengagement with a bore inner surface defining the tapered spaces. A liquid under pressure is supplied through liquid passages to some of liquid pressure chambers at opposite ends of the tapered pistons so that the barrel of the roll body is increased or decreased in diameter. When the rolling forces are removed from the roll body, the roll body returns to its initial straight state.

1 Claim, 14 Drawing Sheets

ROLL FOR ROLLING MILL

BACKGROUND OF THE INVENTION

The present invention relates to a roll for a rolling mill.

A conventional roll of this kind is disclosed for example in U.S. Pat. No. 4,599,770.

The conventional roll comprises, as shown in FIG. 1, a sleeve 3 fitted for example by shrink or expansion fit over a central barrel of a roll core 2 which in turn is rotatably supported at its opposite ends by bearings 1. The sleeve 3 has opposite ends each of which has an inner periphery in the form of a tapered surface 4 diverged toward the end of the core 2; that is, the diameter of the tapered surface 4 is gradually increased toward the end of the core 2 so that an annular space 5 is defined between the core 2 and the tapered surface 4. Piston rings 6 and 7 each having a tapered surface serving as a wedge surface are axially slidably fitted over the core 2 and within the space 5. The space 5 is liquid-tightly closed by a seal ring 8 so that a liquid-pressure chambers 9, 10 and 11 are respectively defined between the blind end of the space 5 and the ring 6, between the rings 6 and 7 and between the rings 7 and 8. The chambers 9, 10 and 11 are respectively communicated with liquid passages 12, 13 and 14 which in turn are formed in the core 2 and are communicated with exterior liquid-pressure source means (not shown). Supply of a liquid under pressure to or discharge of the liquid from the chambers 9, 10 and 11 causes the tapered piston rings 6 and 7 to be axially displaced to thereby be wedged or unwedged in the space 5. As a result, the outer shape of the sleeve 3 or of the roll can be varied.

Use of the rolls with such variable configurations as work rolls, intermediate rolls and/or backup rolls is advantageous in rolling of works with different widths and enables control of thickness distribution of works along their widths as needs demand.

The conventional roll, which comprises the sleeve 3 fitted over the rotatably supported core 2 by shrink or expansion fit, has the following problem. That is, when the rolling forces F are applied to the roll, the latter is deflected as indicated by FIG. 2. In this case, the inside and outside (the upper and lower surface in FIG. 2) distortions of the core 2 due to the deflection are different from each other; however, the inside and outside distortions of the sleeve 3 due to deflection are substantially the same so that the sleeve 3 is axially displaced or dislocated with respect to the core 2 as indicated by 15 in FIG. 2.

Once such axial displacement or dislocation 15 occurs between the roll core 2 and the sleeve 3, even when the rolling forces are removed, the roll remains deflected since the displacement or dislocation 15 cannot disappear because of high contact pressure having been applied between the core 2 and the sleeve 3 due to shrink or expansion fit.

The roll, which cannot be returned to its initial straight state and remains deflected, is eccentrically rotated, resulting in nonuniform distribution of thickness of works in their lengthwise direction.

In view of the above, a primary object of the present invention is to provide a roll for a rolling mill which can return its initial straight state when rolling forces are removed even if it has been deflected by application of the rolling forces.

DETAILED DESCRIPTION OF THE PREFERRED EMBODIMENTS

Figure 1:
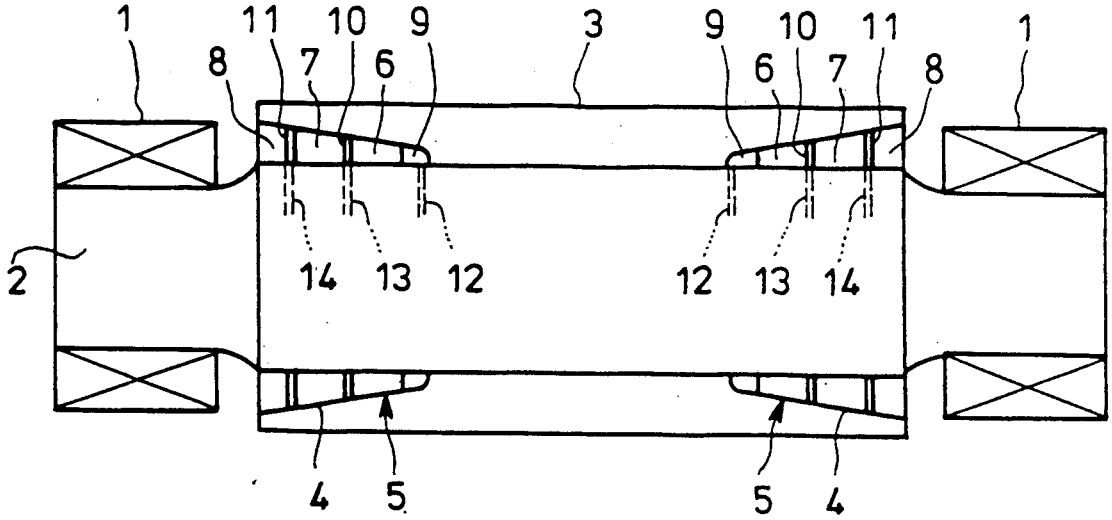
Fig. 1 PRIOR ART
FIG. 1 is a side view in section of a conventional roll for a rolling mill.
Figure 2:
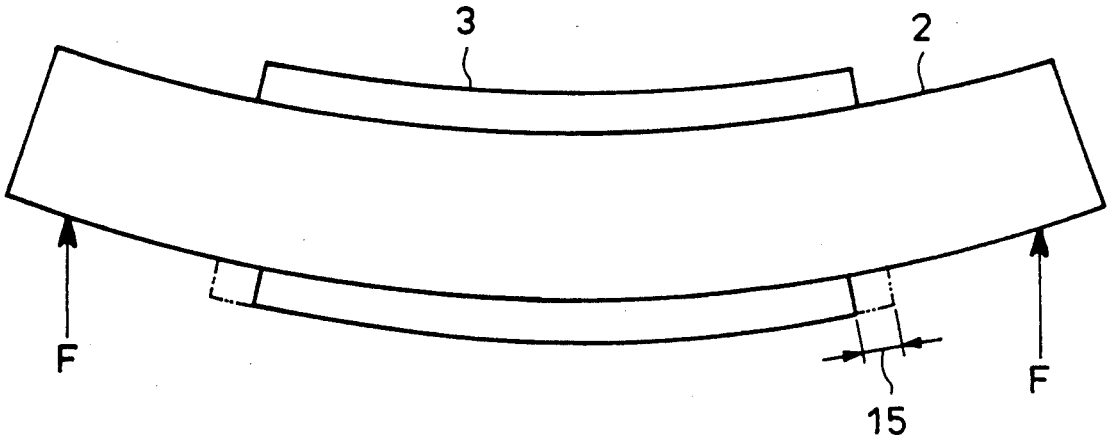
Fig. 2 PRIOR ART
FIG. 2 is a schematic view illustrating rolling forces applied to the roll shown in FIG. 1.
Figure 3:
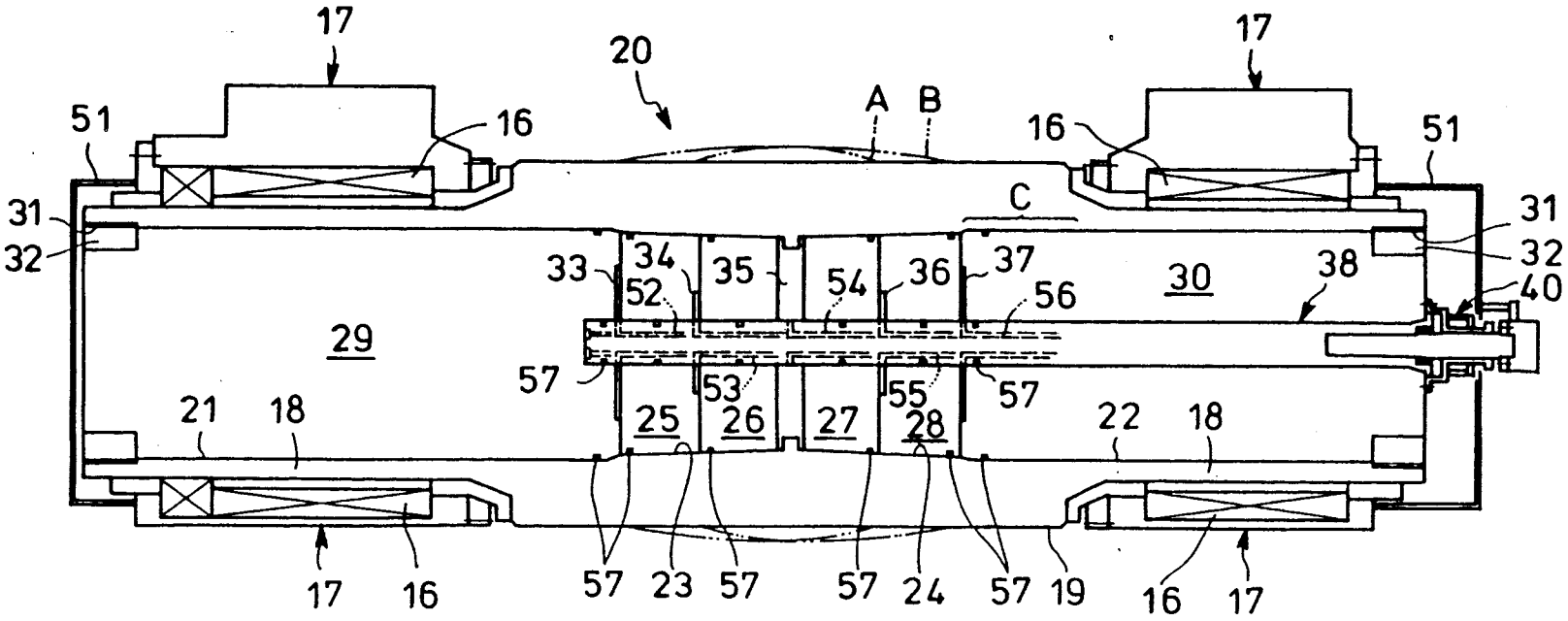
FIG. 3 is a side view in section of a first embodiment of the present invention.
Figure 4:
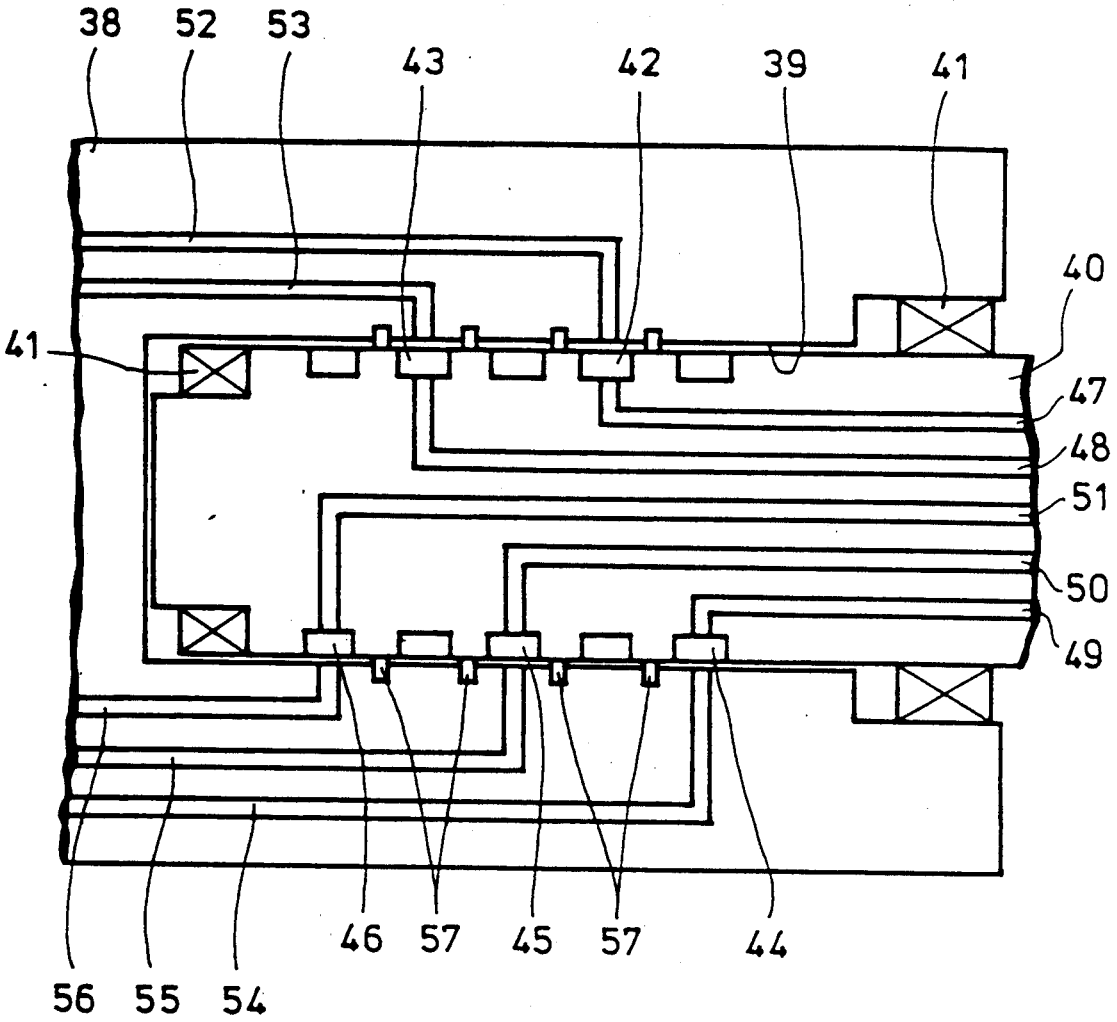
FIG. 4 is an enlarged view of a rotary joint thereof.

FIGS. 3 and 4 illustrate a first embodiment of the present invention in which a roll body 20 with a central barrel 19 is rotatably supported at its opposite ends by bearing supports 18 each supported by a bearing 16 and a bearing box 17. The roll body 20 is bored to have axially extending cylindrical spaces 21 and 22 and frustoconical spaces 23 and 24 which are respectively contiguous with the spaces 21 and 22, the diameter of the frustoconical spaces 23 and 24 being gradually decreased toward the center of the barrel 19.

The frustoconical spaces 23 and 24 accommodate axially movable tapered pistons 25, 26, 27 and 28 which are adapted to make wedge-like contact with the bore inner surface defining the spaces 23 and 24. The cylindrical spaces 21 and 22 accommodate cylindrical shafts 29 and 30 which have holes 31 tapped at the open ends of the cylindrical spaces 21. Set screws 32 are screwed into the holes 31 so that the frustoconical spaces 23 and 24 are liquid-tightly sealed, thereby defining first, second, third, fourth and fifth liquid pressure chambers 33–37 respectively between the shaft 29 and the piston 25, between the pistons 25 and 26, between the pistons 26 and 27, between the pistons 27 and 28 and between the piston 28 and the shaft 30.

A rod 38 for supplying a liquid under pressure axially extends from one end of the roll body 20 though the shaft 30 and the pistons 28, 27, 26 and 25 to the shaft 29. The liquid supply rod 38 has at said one end of the roll body 20 a recess 39 which rotatably supports a rotary joint 40 through a bearings 41 and 41*a*: The rotary joint 40 is formed at its leading end with annular grooves 42–46 which are respectively communicated through liquid passages 47–51 in the rotary joint 40 with exterior liquid sauce means (not shown). The liquid supply rod 38 has liquid passages 52–56 in respective communication with the annular grooves 42–46 and also with the liquid pressure chambers 32–37. Thus, the liquid under pressure can be supplied from the exterior liquid sauce means to the chambers 33–37 through the liquid passages 47–51, the annular grooves 42–46 and the liquid passages 52–56; and the liquid in the chambers 33–37 can be discharged into the exterior liquid source means. Seals 57 are fitted as shown in FIG. 4.

Next the mode of operation of the roll with the above-described construction will be described.

When the liquid under pressure is supplied to the second and fourth chambers 34 and 36, the tapered pistons 26 and 27 are forced to move in the axial direction toward the center of the roll body 20 to be wedged in the tapered spaces 23 and 24. As a result, a small portion at the center of the roll body 20 is forced to expand as indicated by the imaginary lines A in FIG. 3.

When the liquid under pressure is supplied to the first and fifth liquid chambers 33 and 37 under the above-described condition, the tapered pistons 25 and 28 are forced to move in the axial direction toward the center of the roll body 20 to thereby be wedged in the tapered spaces 23 and 24, respectively. As a result, a portion wider than than the above-mentioned small portion is forced to expand as indicated by the imaginary line B in FIG. 3.

On the other hand, when the liquid under pressure is supplied to the third liquid chamber 35, the tapered pistons 25–28 are forced to move in the axial direction away from the center of the roll body 20 to thereby be unwedged or disengaged from the tapered space 23. Thus, the the roll body 20 returns to its initial, flat cylindrical shape free from irregularities.

By combinations of liquid supply and discharge to and from the liquid chambers 33–37, the tapered pistons 25–28 may be respectively engaged with or disengaged from the inner surfaces defining the tapered spaces 23 and 24, so that the outer configuration or shape of the roll body 20 can be arbitrarily varied.

In applying rolling forces to the roll with the above-described construction, it is deflected like conventional rolls; the roll body 20 is however integrally composed of the bearing supports 18 which are rigidly supported by the bearings 16 over wider ranges and are hardly deflected as well as the barrel 19 which is liable to be deflected and therefore has no displacement or dislocation caused by the difference in the degree of deflection. As a result, when the rolling forces are removed, the roll body 20 can return to its initial straight state.

The shafts 29 and 30 fitted into the roll body 20 are rigidly supported by the bearings 16 and are substantially free from deflection, their deflectable portions C being small as shown. Moreover the surfaces of the shafts 29 and 30 are relatively near the axis of the roll body 20 and are less affected by deflection. In addition, the shafts 29 and 30, which are securely attached to the roll body 20 only with the set screws 32, have no great surface-contact pressure unlike the case of shrink or expansion fit so that they can easily return to their initial states even when any distortions due to deflection should have occurred. Thus, when the rolling forces are removed, the roll body 20 can completely return to its initial straight state.

It should be noted here that even when the shafts 29 and 30 are fitted into the roll body 20 by shrink or expansion fit, because of the other reasons described above, displacement or dislocation of the shafts 29 and 30 relative to the roll body 20 are almost negligible.

Figure 5:
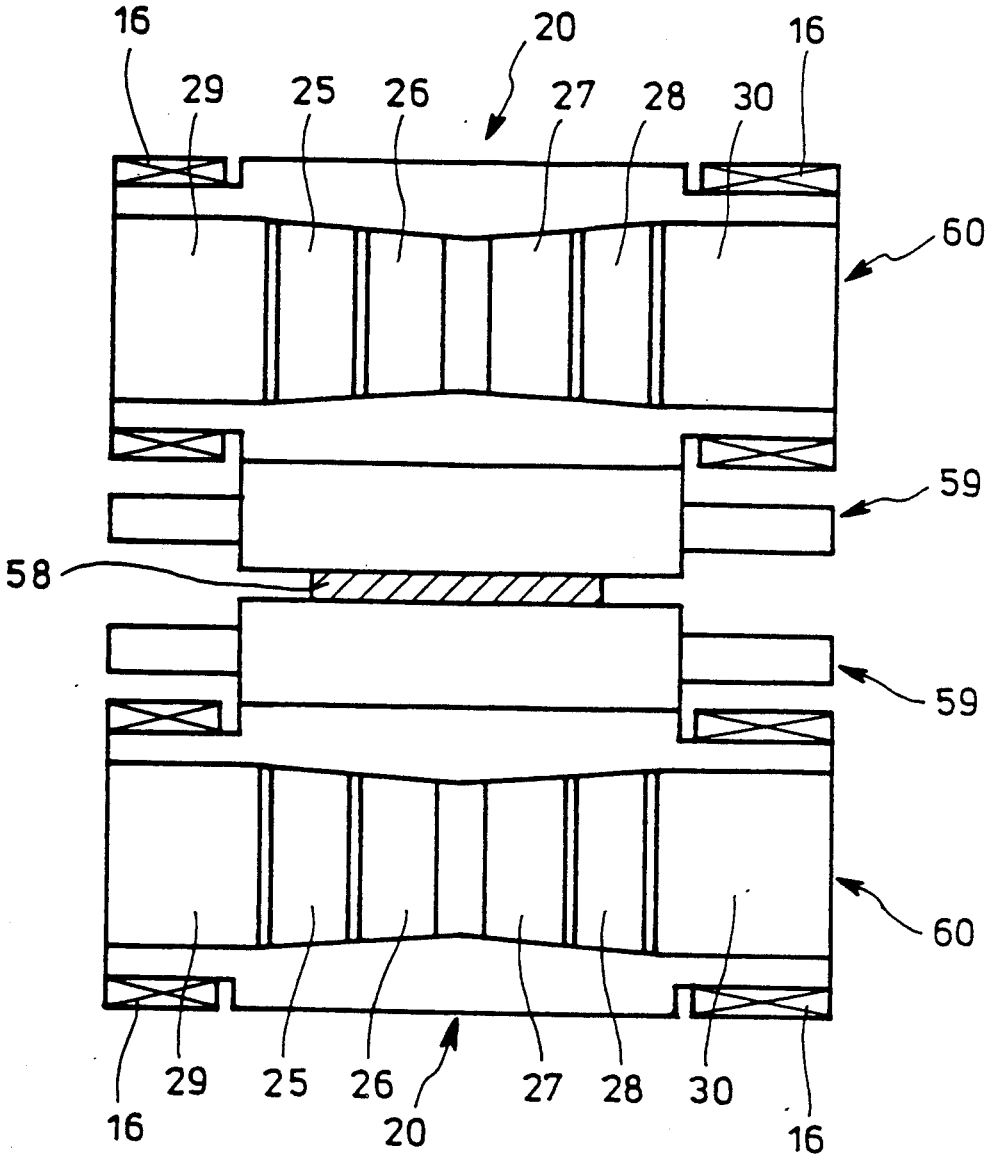
FIGS. 5–10 are front views of four-high rolling mills with the rotary joints shown in FIG. 3.

Referring next to FIG. 5, a four-high rolling mill in which the rolls with the above-described construction are used as backup rolls will be described.

In FIG. 5, reference numeral 58 represents a work; 59, work rolls; and 60, backup rolls.

In order to roll the work 58 having a narrow width, the tapered pistons 26 and 27 are wedged while the tapered pistons 25 and 28 are disengaged. Then, each of the backup rolls 60 has an outer shape with its central portion being slightly increased in diameter as indicated by the imaginary line A in FIG. 3. Such central portion increased in diameter becomes an effective roll length along which the rolling forces are transmitted through the work roll 59.

In order to roll the work 58 having an intermediate width, the tapered pistons 25, 26, 27 and 28 are wedged. Then, each of the backup rolls 60 has an outer shape in which a central portion larger than the above-described central portion in the case of the small-width work 58 is increased in diameter as indicated by the imaginary line B in FIG. 3. Such central portion increased in diameter becomes an effective roll length along which the rolling forces are transmitted through the work roll 59.

In order to roll the work 58 having a wider width, the tapered pistons 25, 26, 27 and 28 are disengaged. Then, the whole of the barrel of each of the backup rolls 60 becomes an effective roll length along which the rolling forces are transmitted through the work roll 59.

Thus, in response to the width of a work 58, the shape of each of the backup rolls 60 can be adjusted to control occurrence of crown of the work 58.

The tapered pistons 25, 26, 27 and 28 can be wedged or unwedged independently from each other so that the backup roll 60 may assure any suitable shape. As a result, it becomes possible to control the distribution of the thickness of the work 58 in the widthwise direction in any manner.

Generally in a four-high rolling mill, backup rolls are supported at their ends vertically immovably while work rolls are supported at their ends vertical movably. Therefore, any eccentric rotation of the work rolls will not adversely affect the distribution of thickness of a work since the work rolls may be vertically moved to maintain the rolling-pressure applied surfaces at a predetermined height; whereas eccentric rotation of the backup rolls will cause the height of the rolling-pressure applied surfaces to be vertically varied and adversely affect the distribution of the thickness of the work, resulting in nonuniformness thereof in the lengthwise direction.

However, in the case where the rolls in accordance with the present invention are used as backup rolls 60, when the rolling forces are removed, the rolls can return to their initial straight states. Therefore, the adverse effect on the distribution of thickness described above can be eliminated and the rolled work 58 has uniform distribution of thickness in the lengthwise direction.

Figure 6:
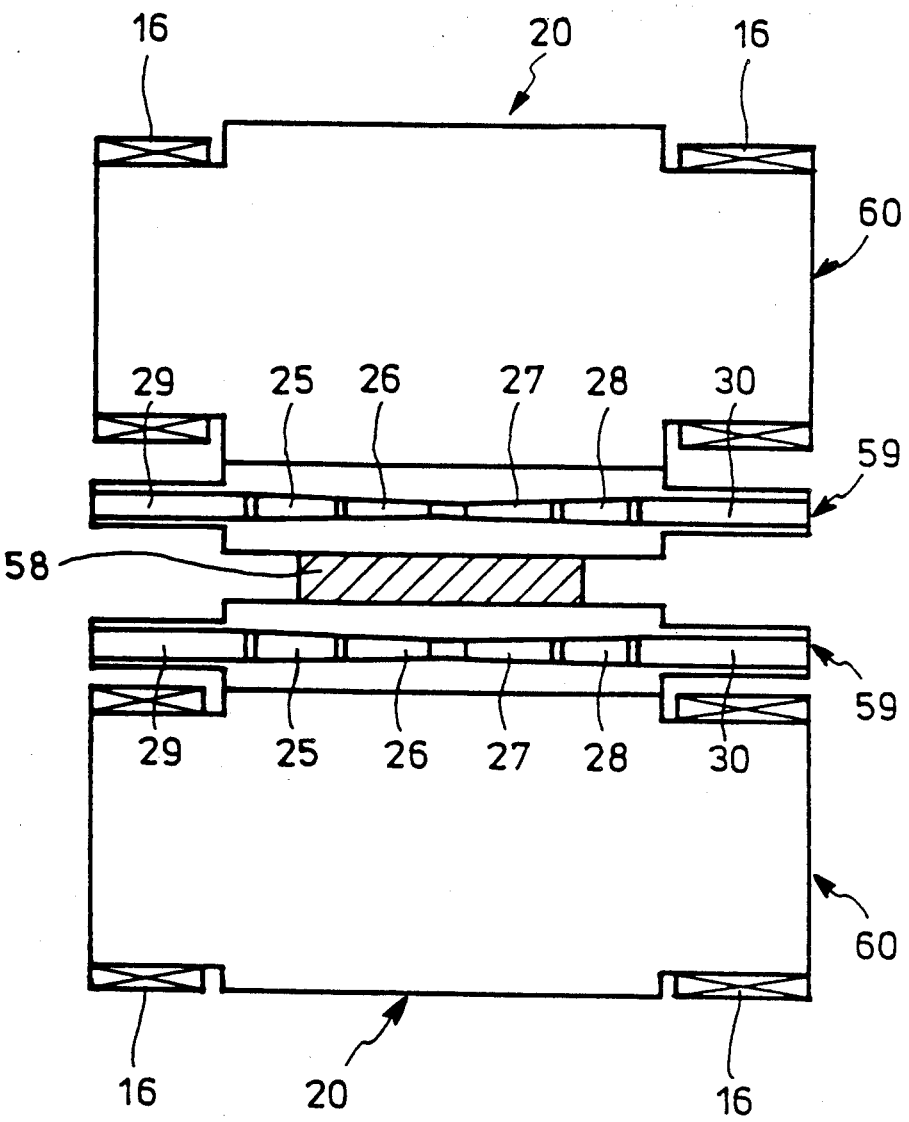
Figure 7:
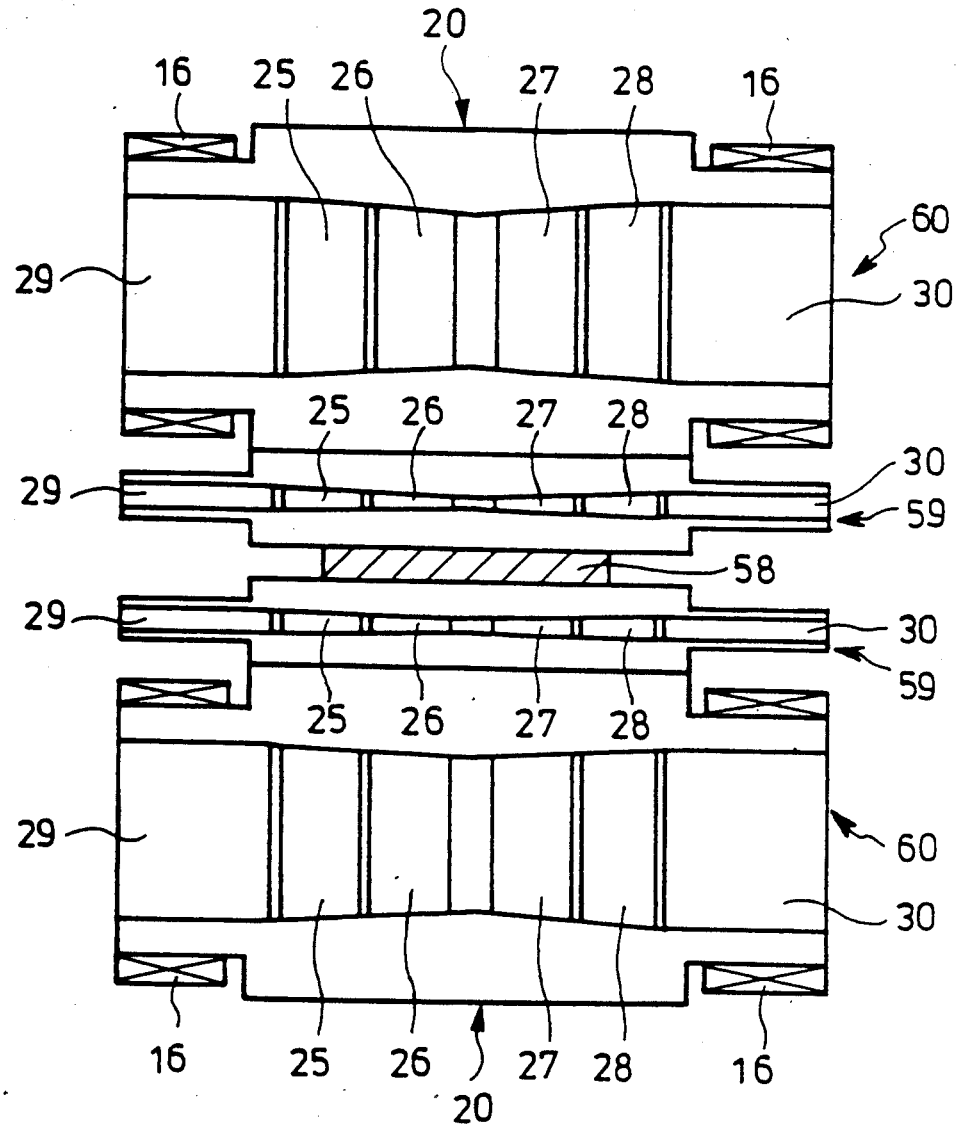
Figure 8:
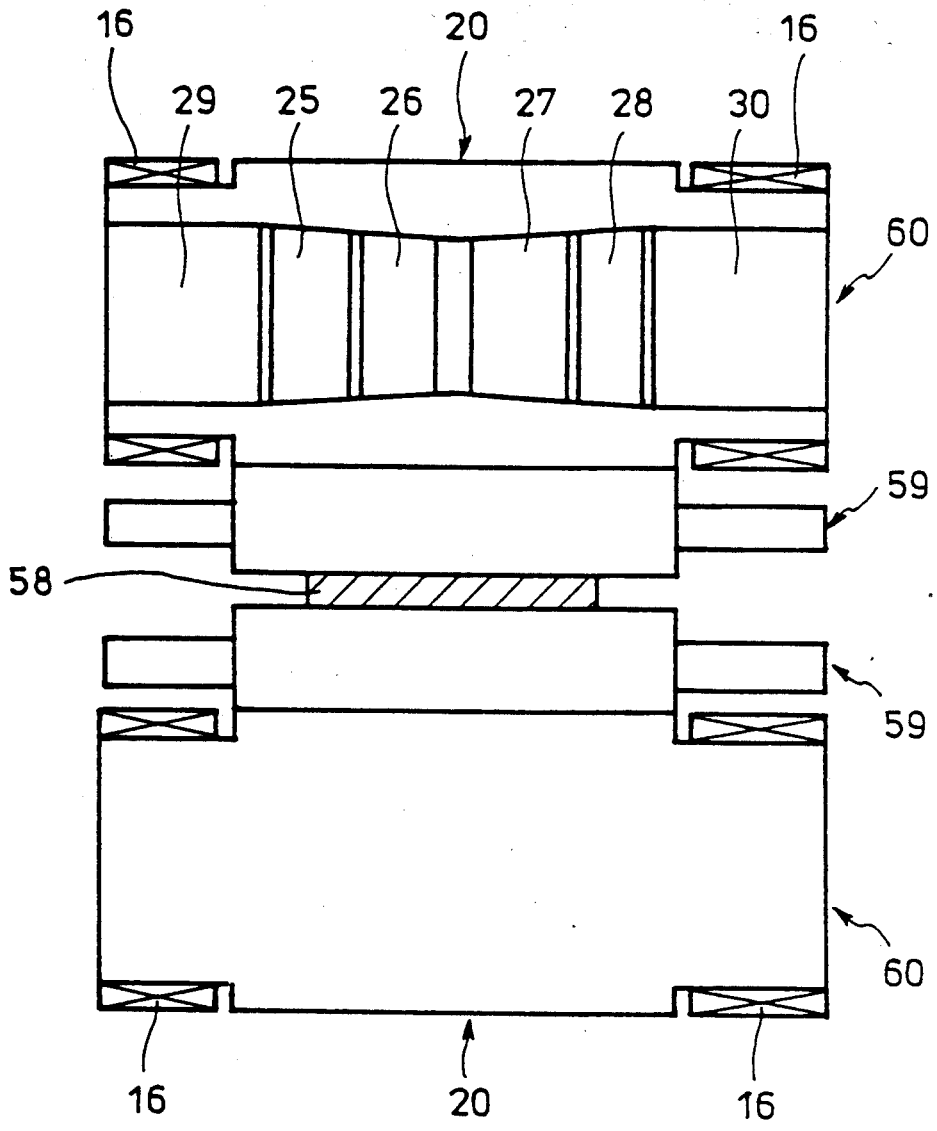
Figure 9:
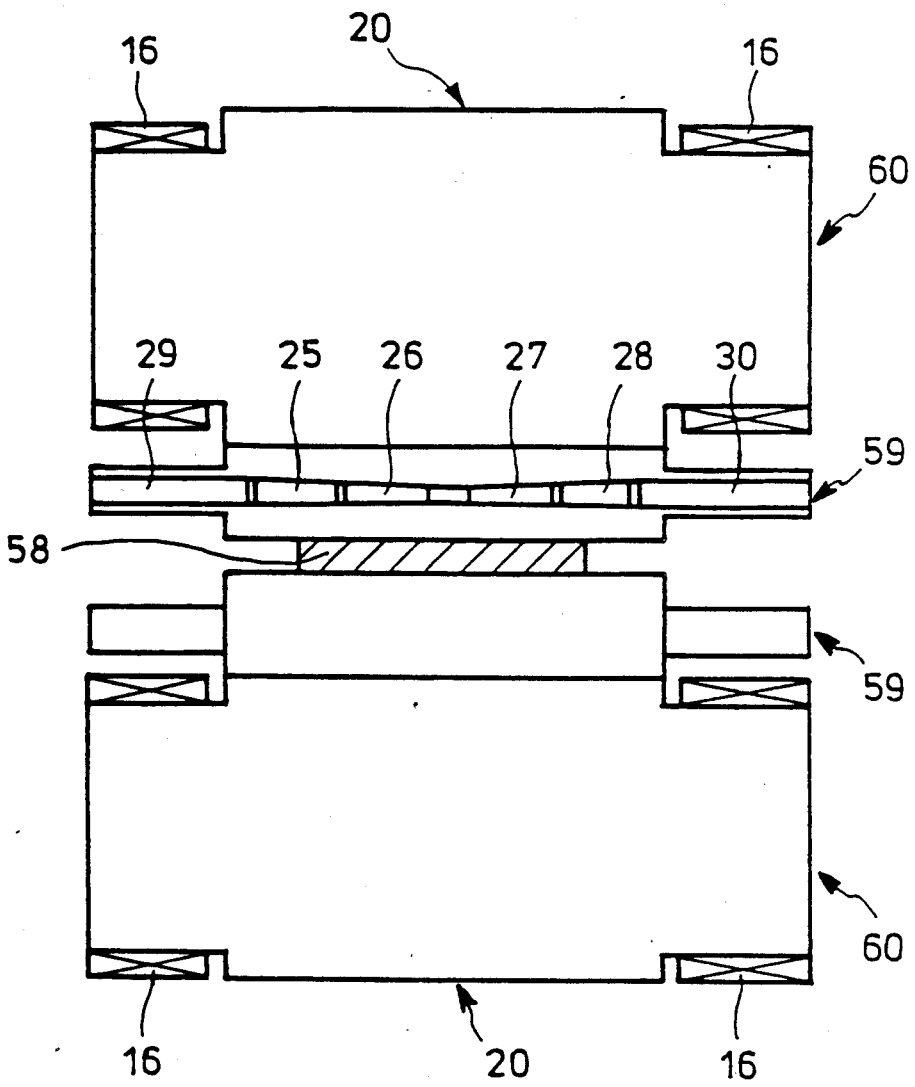
Figure 10:
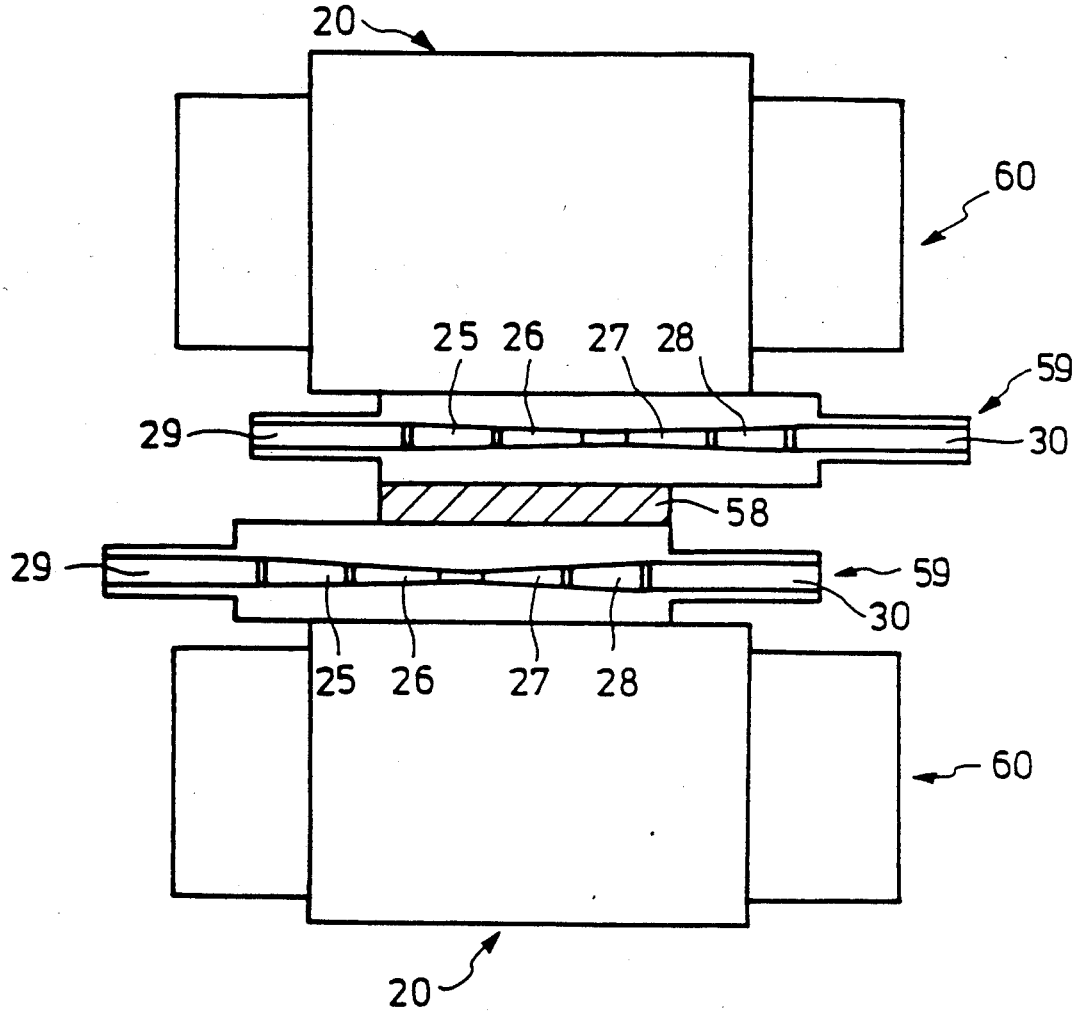

With respect to the four-high rolling mill, the rolls in accordance with the present invention may be alternatively used as the work rolls 59 as shown in FIG. 6; they may be used as both the work rolls 59 and backup rolls 60 as shown in FIG. 7; the roll may be used only one of a pair of backup rolls 60 as shown in FIG. 8; the roll may be used as only one of a pair of work rolls 59 as shown in FIG. 9; and the rolls may be used in a four-high rolling mill having shift capability as shown in FIG. 10.

Figure 11:
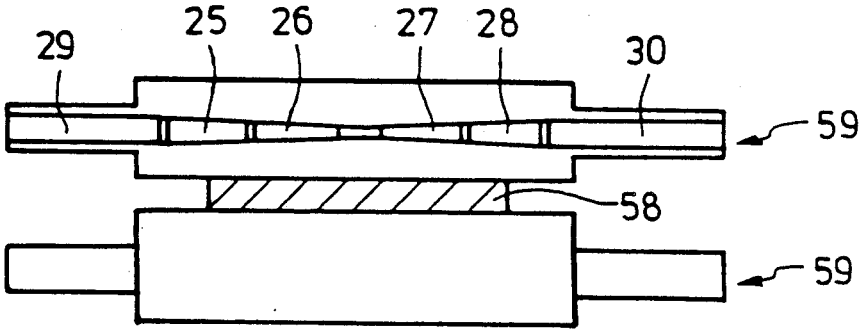
FIG. 11 is a front view of a two-high rolling mill with the rotary joint shown in FIG. 3.
Figure 12:
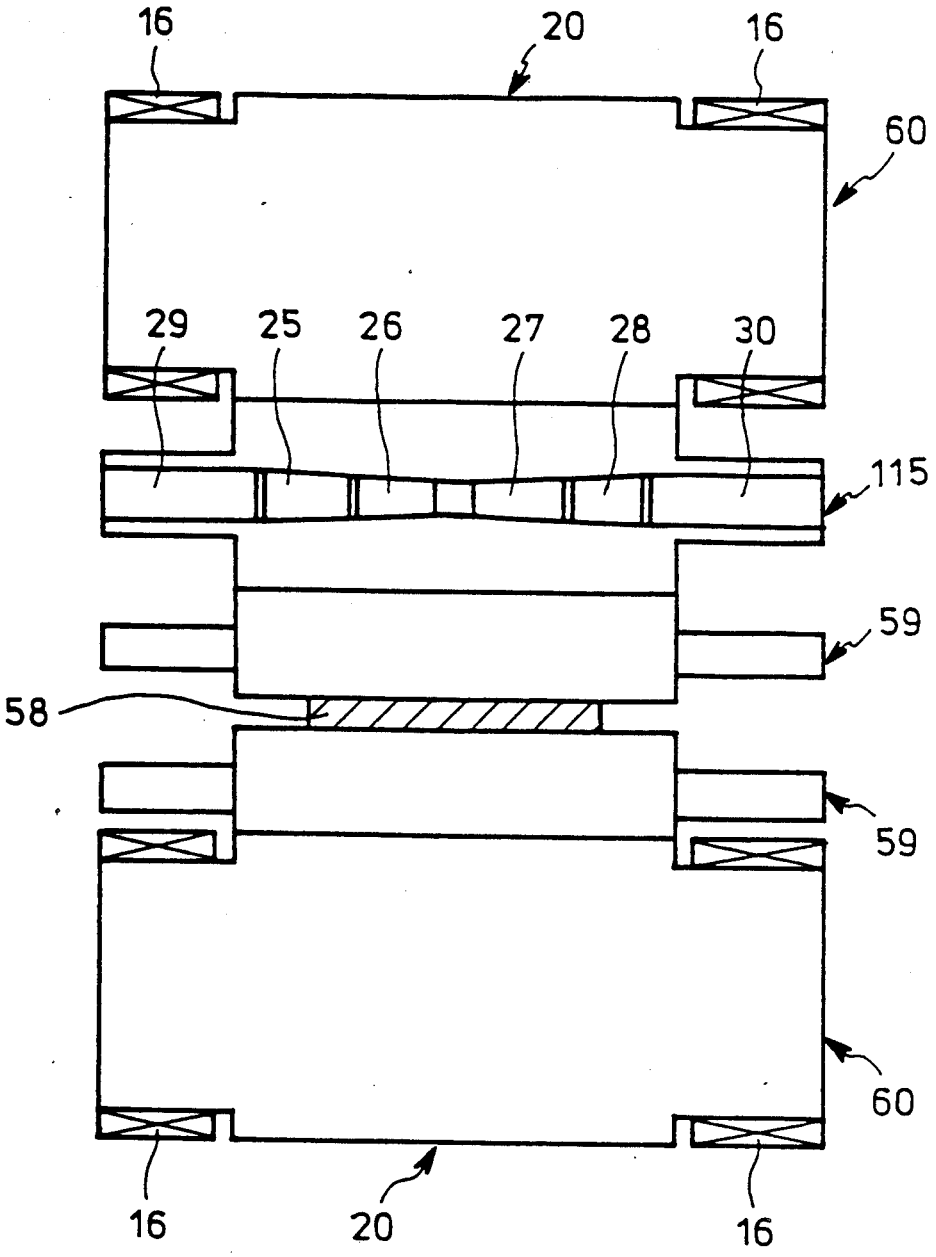
FIG. 12 is a front view of a five-high rolling mill with the rotary joint shown in FIG. 3.
Figure 13:
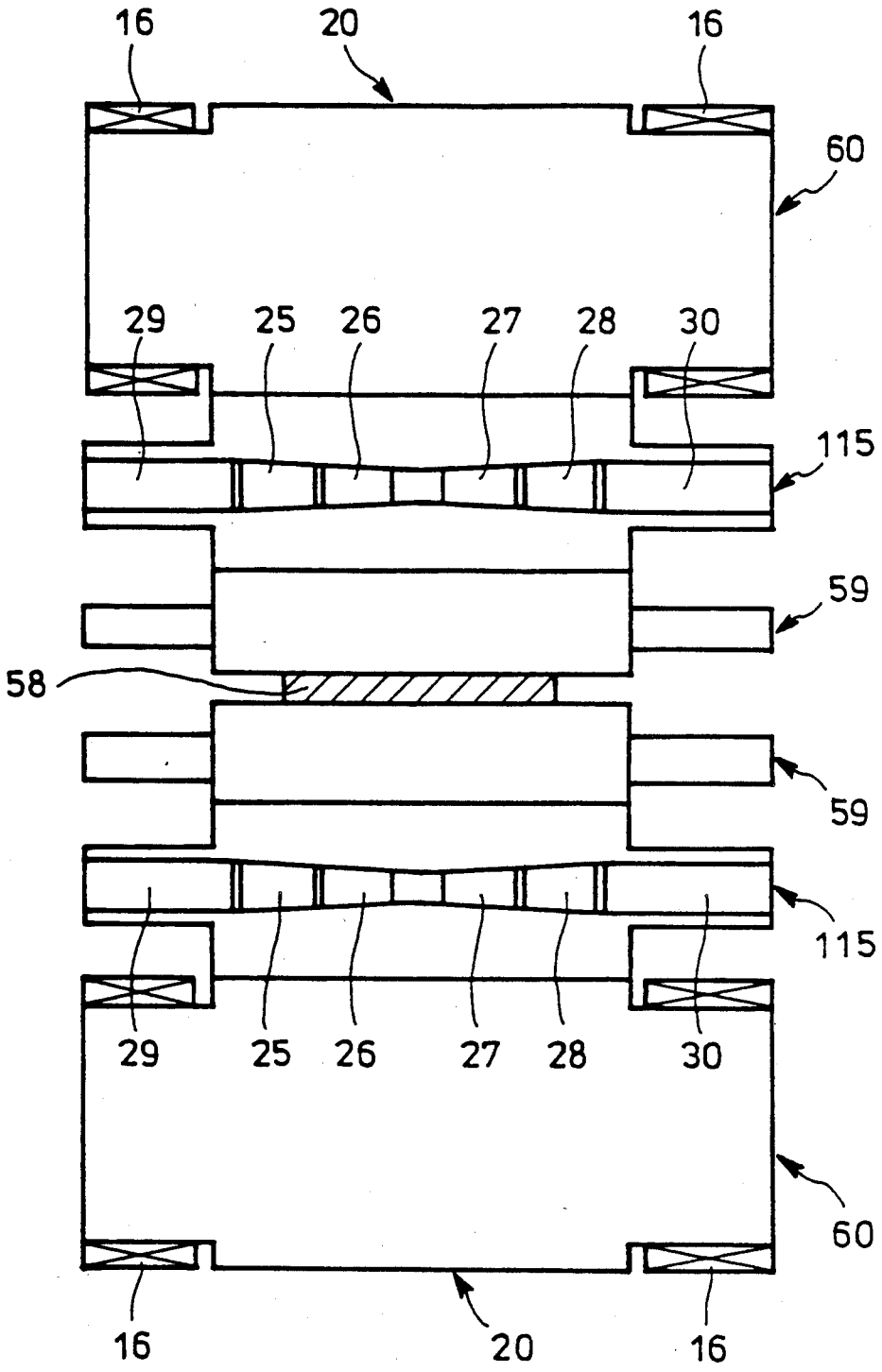
FIG. 13 is a front view of a six-high rolling mill with the rotary joint shown in FIG. 3.

Furthermore, the rolls in accordance with the present invention may be used as working rolls 59 in a two-high rolling mill as shown in FIG. 11; they may be used in a three-high rolling mill; they may be used as for example intermediate rolls 115 in a five-high rolling mill as shown in FIG. 12; and they may be used as for example intermediate rolls 115 in a six-high rolling mill as shown in FIG. 13.

In the rolling mills shown in FIGS. 6–13, roll bending systems may be of course incorporated.

Figure 14:
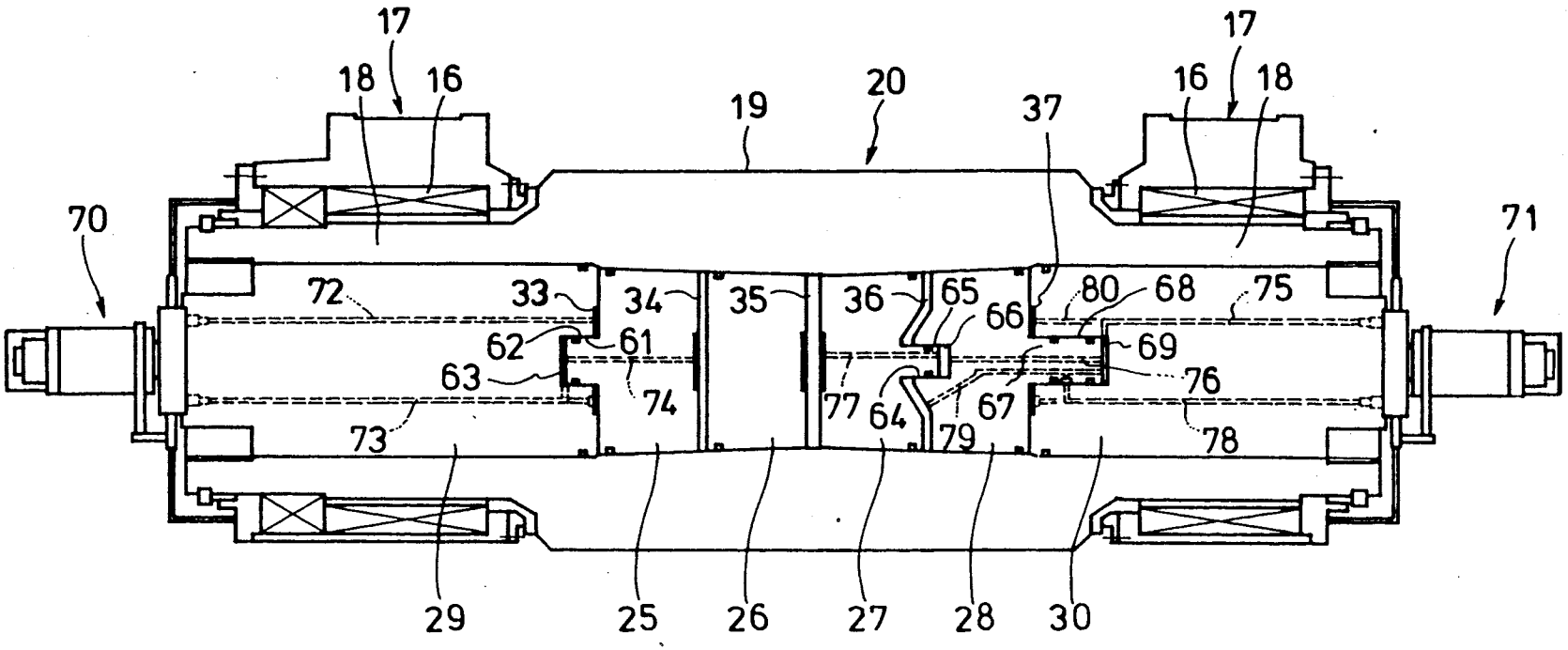
FIG. 14 a side view in section of a second embodiment of the present invention.

A second embodiment shown in FIG. 14 is substantially similar in construction to the first embodiment described above with reference to FIGS. 3 and 4 except that the liquid under pressure can be supplied to the liquid chambers 33–37 without use of the liquid supply rod 38. A liquid chamber 63 is defined between a projection 61 on the piston 25 and a recess 62 on the shaft 29. In like manner, a liquid chamber 66 is defined between a projection 64 on the piston 27 and a recess 65 on the piston 28; and a liquid chamber 69, between a projection 67 on the piston 28 and a recess 68 on the shaft 30. Rotary joints 70 and 71 are attached to opposite ends of the roll body 20 so that the liquid under pressure from the rotary joint 70 is supplied to the first liquid chamber 33 through a liquid passage 72 in the shaft 29. In like manner, the liquid under pressure from the rotary joint 70 is supplied to the second liquid chamber 34 through a liquid passage 73 in the shaft 29, the liquid chamber 63 and a liquid passage 74 in the piston 25. The liquid under pressure from the rotary joint 71 is also supplied to the third liquid chamber 35 through a liquid passage 75 in the shaft 30, a liquid chamber 69, a liquid passage 76 in the piston 28, a liquid chamber 66 and a liquid passage 77 in the piston 27. In like manner, the liquid under pressure from the rotary joint 71 is supplied to the fourth liquid chamber 36 through a liquid passage 78 in the shaft 30 and a liquid passage 79 in the piston 28. The liquid under pressure from the rotary joint 71 is also supplied to the fifth liquid chamber 37 through a liquid passage 80 in the shaft 30.

The second embodiment with the above-described construction can attain the effects substantially similar to those of the first embodiment.

Figure 15:
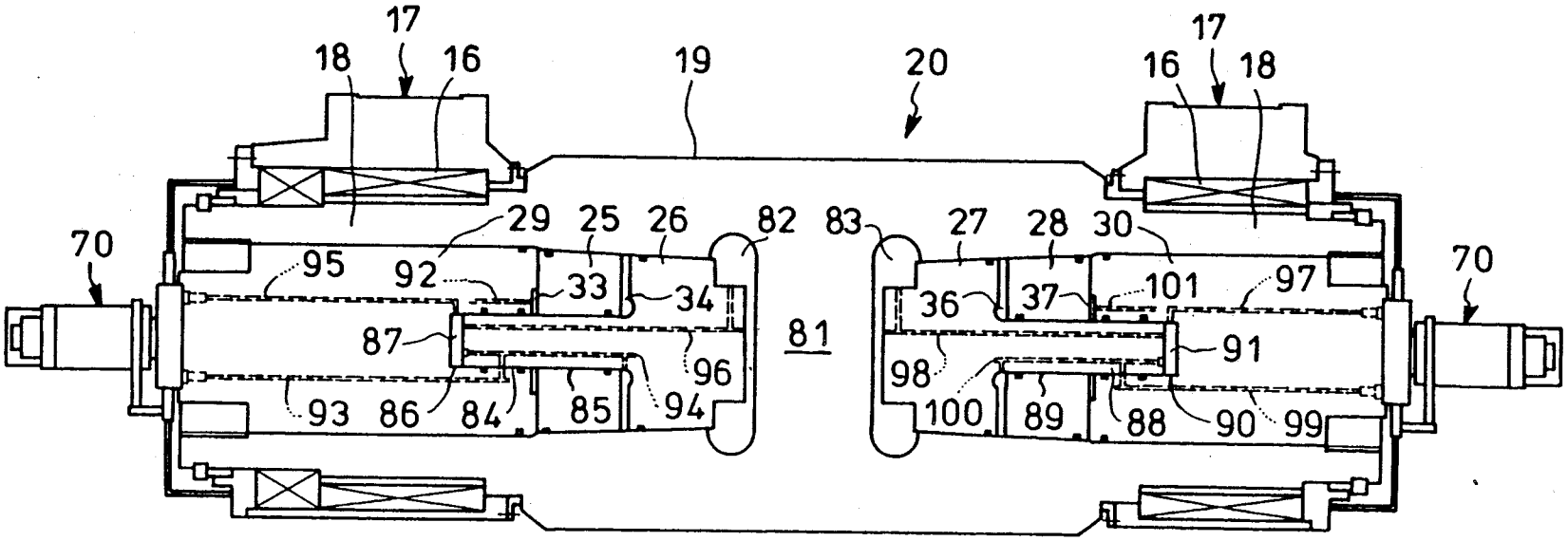
FIG. 15 is a side view in section of a third embodiment of the present invention.

The third embodiment shown in FIG. 15 is substantially similar in construction to the first or second embodiment except that the tapered pistons 25, 26, 27 and 28 are disposed closer to the ends of the barrel 19 and the third liquid chamber 35 shown in FIG. 3 is divided into two liquid chambers 82 and 83 by a solid portion 81 so that the ends of the barrel 19 can be increased or decreased in diameter. The same effects of the first and second embodiments can be also attained by the third embodiment.

Reference numeral 84 represents a projection on the piston 26; 85, a through hole in the piston 25; 86, a recess on the shaft 29; 87, a liquid chamber defined between the projection 84 and the recess 86; 88, a projection on the piston 27; 89, a through hole in the piston 28; 90, a recess on the shaft 30; 91, a liquid chamber defined between the projection 88 and the recess 90; and 92–101, liquid passages. The liquid under pressure can be respectively supplied to the liquid chambers 33, 34, 82, 83, 36 and 37 in a manner substantially similar to that described in the second embodiment.

Figure 16:
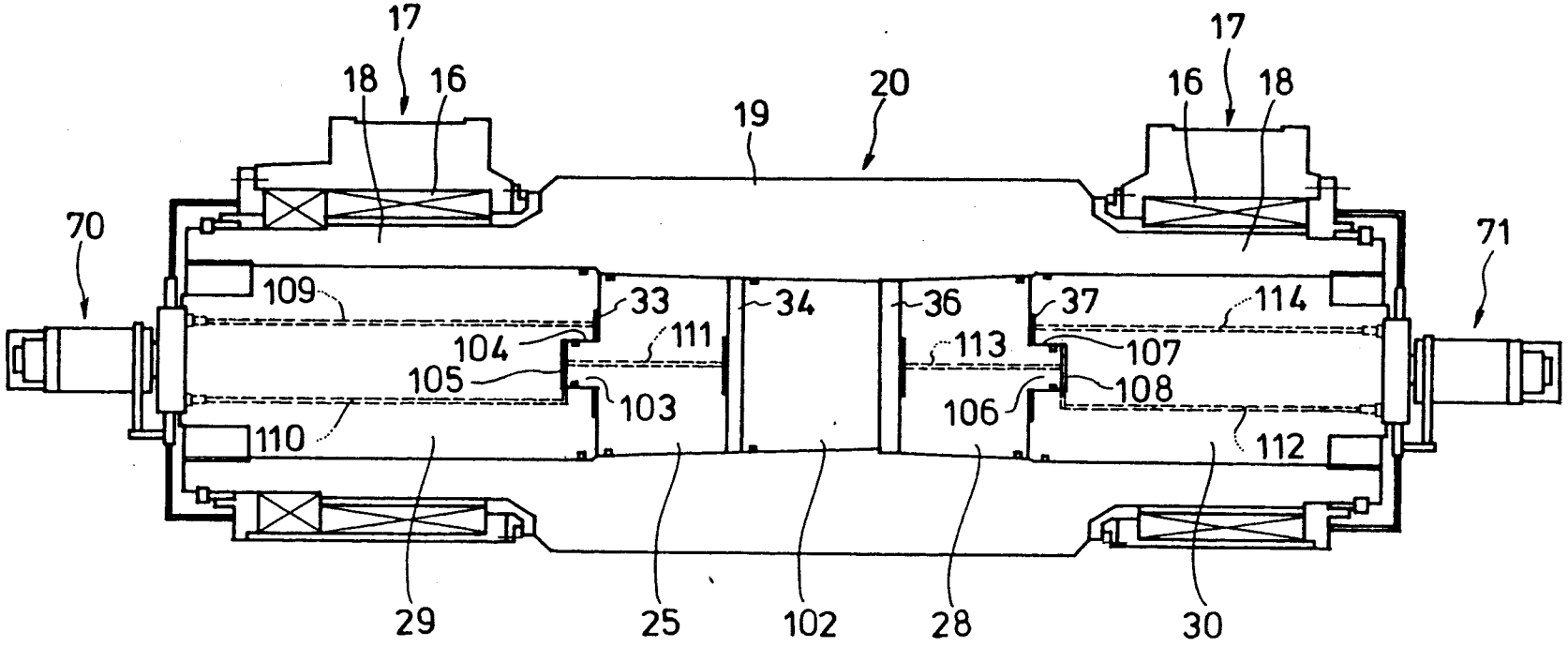
FIG. 16 is a side view in section of a fourth embodiment of the present invention.

A fourth embodiment shown in FIG. 16 is substantially similar in construction to the first, second or third embodiment described above except that the tapered pistons 26 and 27 in FIG. 3 are made integral to provide a single tapered piston 102 for increase or decrease in diameter of the barrel 19. The fourth embodiment can attain the similar effects to those attained by the first, second and third embodiments.

Reference numeral 103 represents a projection on the piston 25; 104, a recess on the shaft 29; 105, a liquid chamber defined between the projection 103 and the recess 104; 106, a projection on the piston 28; 107, a recess on the shaft 30; 108, a liquid chamber defined between the projection 106 and the recess 107; and 109–114, liquid passages. As in the case of the second or third embodiment, the liquid under pressure can be supplied to the liquid chambers 33, 34, 36 and 37, respectively.

It is to be understood that the present invention is not limited to the above-described embodiments and that various modifications may be effected within the true spirit of the present invention.

As described above, the rolls for the rolling mills in accordance with the present invention can attain the following excellent effects:

(1) Even if the roll is deflected due to the rolling pressure, it can return to its initial straight shape when the rolling pressure is removed;

(2) When the rolls are incorporated in a rolling mill, a uniform distribution of thickness of a work in the lengthwise direction thereof can be attained;

(3) The outer shape of the roll can be varied so that when the roll is used as a work roll, an intermediate roll or a backup roll, the roll can be easily adjusted in response to the width of a work and can control the distribution of thickness of the work.

What is claimed is:

1. A roll for a rolling mill comprising a roll body having a barrel and bearing supports integral with said barrel, said bearing supports serving as supports for rotatably supporting the roll body with respect to an outer frame, said roll body being bored to provide liquid-tight, frustoconical tapered spaces at the axis of the roll body and axially extending in the barrel, axially movable, frustoconical tapered piston means selectively wedged and disengaged to and from a bore inner surface defining said tapered spaces, said tapered piston means being disposed in said spaces to thereby provide liquid-pressure chamber means at opposite ends of said tapered piston means and liquid passage means in communication with said liquid-pressure chamber means.

* * * * *